US007166174B2

(12) United States Patent
De Bondt et al.

(10) Patent No.: US 7,166,174 B2
(45) Date of Patent: Jan. 23, 2007

(54) BUNDLE DRAWN STAINLESS STEEL FIBERS

(75) Inventors: Stefaan De Bondt, Deerlijk (BE); Jaak Decrop, Brugge (BE)

(73) Assignee: NV Bekaert SA, Zwevegem (BE)

( * ) Notice: Subject to any disclaimer, the term of this patent is extended or adjusted under 35 U.S.C. 154(b) by 112 days.

(21) Appl. No.: 10/482,379

(22) PCT Filed: Jul. 2, 2002

(86) PCT No.: PCT/EP02/07269

§ 371 (c)(1),
(2), (4) Date: Feb. 20, 2004

(87) PCT Pub. No.: WO03/010353

PCT Pub. Date: Feb. 6, 2003

(65) Prior Publication Data

US 2004/0265576 A1 Dec. 30, 2004

(30) Foreign Application Priority Data

Jul. 20, 2001 (EP) ..... 01202775

(51) Int. Cl.
*C21D 11/00* (2006.01)
*B32P 17/00* (2006.01)

(52) U.S. Cl. ..... 148/500; 148/506; 148/597; 148/598; 148/648; 428/606; 428/607; 428/379; 428/615; 29/419.1; 29/424

(58) Field of Classification Search ..... 428/606, 428/607, 610, 615, 619, 638, 656, 666, 655, 428/685, 677, 668, 664, 923, 379; 148/500, 148/505, 506, 510, 503, 504, 527, 529, 532, 148/537, 548, 595, 597, 598, 605, 608, 648; 420/45, 46, 47, 49, 50, 51, 52, 53, 56, 57, 420/58, 60, 61, 62, 91, 92, 93, 95, 96, 97, 420/98, 117, 118, 119, 120, 123, 128; 29/419.1, 29/424

See application file for complete search history.

(56) References Cited

U.S. PATENT DOCUMENTS

| | | | | |
|---|---|---|---|---|
| 2,050,298 | A | 8/1936 | Everett | |
| 3,379,000 | A * | 4/1968 | Webber et al. | 57/243 |
| 3,698,963 | A * | 10/1972 | Nunes et al. | 428/685 |
| 4,042,421 | A | 8/1977 | Van Den Sype et al. | |
| 4,925,539 | A * | 5/1990 | Francois | 205/717 |

(Continued)

FOREIGN PATENT DOCUMENTS

EP 0 337 517 B1 10/1989

(Continued)

*Primary Examiner*—Jill Gray
(74) *Attorney, Agent, or Firm*—Foley & Lardner LLP

(57) ABSTRACT

The invention relates to stainless steel fibers obtained by bundled drawing of stainless steel wires embedded in a matrix material. The composition of the stainless steel fibers comprises iron and the following components expressed in percent by weight: C £ 0.05%, Mn £ 5%, Si £ 2%, 8 £ Ni £ 12%, 15% £ Cr £ 20%, Mo £ 3%, Cu £ 4%, N £ 0.05%, S £ 0.03% and P £ 0.05%. The invention further relates to a method of manufacturing stainless steel fibers.

41 Claims, 3 Drawing Sheets

U.S. PATENT DOCUMENTS 5,071,713 A * 12/1991 Francois ..... 428/606
5,362,439 A 11/1994 Bletton et al.
5,890,272 A * 4/1999 Liberman et al. ..... 29/419.1
6,048,416 A 4/2000 Hauser et al.
6,106,639 A 8/2000 Marandel et al.
6,112,395 A * 9/2000 Quick et al. ..... 29/419.1
6,497,029 B1 * 12/2002 Quick et al. ..... 29/419.1
2004/0247848 A1 * 12/2004 De Bondt et al. ..... 428/292.1
2004/0265576 A1 * 12/2004 De Brond et al. ..... 428/364

FOREIGN PATENT DOCUMENTS

EP 0 851 039 B1 7/1998
EP 0 953 651 B1 11/1999
GB 1 424 458 2/1976
WO WO 99/24216 A1 5/1999

* cited by examiner

BUNDLE DRAWN STAINLESS STEEL FIBERS

FIELD OF THE INVENTION

The present invention relates to stainless steel fibers and bundles of stainless steel fibers, obtained by the bundled drawing of wires. The invention further relates to a process for manufacturing such stainless steel fibers.

BACKGROUND OF THE INVENTION

In bundled drawing of stainless steel fibers a number of stainless steel wires are bundled and drawn together. The individual wires are separated from one another by covering each stainless steel wire, possibly even on wire rod diameter, with a suitable matrix material. All stainless steel wires, covered with matrix material, are enveloped in an envelope material. Once the bundle of enveloped wires, also called the composite wire, is drawn to the desired diameter, the envelope material and the matrix material are removed, usually by leaching. Very often a metal such as iron or copper is used as matrix and/or envelope material. The use of such metal as matrix material is advantageous since a metal has similar deformability properties as the stainless steel wire that has to be drawn into stainless steel fibers. The metal matrix material is compatible with the stainless steel wires during the drawing and annealing operations. The metal matrix material has a lower chemical resistance and allows the stainless steel fibers to be freed from the matrix material in a leaching process quite easily. An important drawback of using a metal as matrix material is the mutual solubility of stainless steel and matrix material that may be observed during heat treatments. This drawback is observed especially with stainless steels that have quick cold work hardening and therefore require frequent heat treatments e.g. AISI 302.

Intermediate heat treatments, performed between two drawing steps, result in a diffusion of elements of the matrix material into the stainless steel wires and/or in a diffusion of the elements of the stainless steel wires into the matrix material. This has as consequence that the composition of the steel may be changed to some extent after a heat treatment. This effect is most pronounced at the surface of the stainless steel fibers.

Differences in the composition of the stainless steel due to diffusion may cause unreliability of the properties of the stainless steel fibers, for example in the electrical and chemical properties or in the behavior of the stainless steel fibers exposed to high temperatures.

Prior art provides only one solution to the drawback of inhomogeneous surface composition of stainless steel fiber, being the use of electrochemical leaching as process for removing the matrix material as described in EP337517A1. This method is not industrially attractive due to excessive investment costs, causing significant cost price increase of the fibers so obtained.

Another consequence of the diffusion is that more matrix material is necessary in order to assure a separation of the stainless steel fibers during manufacturing of the stainless steel fibers.

SUMMARY OF THE INVENTION

It is an object of the present invention to provide stainless steel fibers having more reliable properties over the length and circumference of the fibers and with less contamination by diffusion of matrix elements into the fiber over the whole surface of the fibers.

According to the present invention, stainless steel fibers, obtained by the bundled drawing of stainless steel wires embedded in a matrix material and/or in an envelope material, have a composition comprising iron and the following components expressed in percent by weight:

$C \leqq 0.05\%$
$Mn \leqq 5\%$
$Si \leqq 2\%$
$8 \leqq Ni \leqq 12\%$
$15\% \leqq Cr \leqq 20\%$
$Mo \leqq 3\%$
$Cu \leqq 4\%$
$N \leqq 0.05\%$
$S \leqq 0.03\%$
$P \leqq 0.05\%$ Since the stainless steel fibers are obtained by bundled drawing process, 'matrix material' is to be understood as the material applied on the individual stainless steel wires for the bundled drawing process. Such matrix material may for example be copper, iron or a copper or iron alloy. During bundled drawing, usually a bundle of stainless steel wires are enveloped after being embedded into a matrix material. The envelope material is defined as the material applied on a bundle of stainless steel wires on which a matrix material is applied. Such an enveloped bundle of stainless steel wires, being embedded in a matrix material is hereafter referred to as 'composite wire'.

Usually, 50 to 2000 stainless steel wires are bundled into a composite wire. After reduction of the diameter of the composite wire, and removing of the enveloping and matrix material, an obtained bundle of stainless steel fibers as subject of the invention comprises 50 to 2000 stainless steel fibers. Most preferably 90 to 1000 stainless steel wires are bundled.

The stainless steel fibers according to the present invention have an equivalent diameter ranging between 0.5 and 100 μm, and preferably between 1 and 50 μm. Equivalent diameter is defined as the diameter of an imaginary circle, of which the surface area is identical to the surface area of a cross section of the stainless steel fiber.

According to the present invention, it was found that the bundle of stainless steel fibers have substantially equal properties over the length of the fibers and a substantially homogeneous composition, with less contamination due to diffusion of matrix material, over the whole surface of the fibers. The diffusion of individual elements from the matrix material, such as copper or iron, into the stainless steel fiber is less than 1 at % at a depth of 100 nm below the surface of the stainless steel fiber, independent from the process used to remove the matrix and enveloping material, e.g. by chemical or electrochemical leaching.

Such improved properties are obtained since these bundles of stainless steel fibers require less annealing treatments during the drawing of the composite wire to its final diameter. It is possible to reduce the number of annealing treatments because the steel composition allows high deformation between two annealing treatments.

During annealing treatments, the depth of diffusion of matrix elements into the stainless steel wires in the composite wire increases; during reduction of the diameter of the composite wire, the depth of diffusion decreases proportionally with the diameter reduction. The high deformability of the steel described in the present invention can advantageously be used to reduce the number of annealing treatments and to increase the deformation between annealing treatments or reduction towards the final diameter. These two advantages have both positively effect on the compositional homogeneity of the stainless steel fibers as compared to what is presently known. First of all, diffusion depth may be reduced by a factor 3 or more. Further, the length over which product properties change may be increased by a factor 10 or more, compared to presently known stainless steel fibers.

The homogeneity of the stainless steel fiber according to the present invention is an important advantage over other stainless steel fibers known in the art, since even a small change in the surface composition of the fibers may have influences on the properties of the stainless steel fibers. For example the oxidation and corrosion resistance of stainless steel fibers is dependent upon the compositional homogeneity of the stainless steel fiber surfaces.

It was found that the properties of the stainless steel fibers according to the present invention are more uniform over a taken length of a stainless steel fiber as subject of the invention, compared to a presently known stainless steel fiber, obtained by bundled drawing. Such improved compositional homogeneity provides associated fiber properties, which are more reliable and predictable, and allow a more reliable and economical preventive replacement of such fibers and products comprising these stainless steel fibers.

Preferably, to reach a preferred level of deformability of the composite wire, the composition of the stainless steel satisfies the following relationship:

$MI \leqq -40$, where $MI = 551 - 462 \times (C\ \% + N\ \%) - 9.2 \times Si\ \% - 20 \times Mn\ \% - 13.7 \times Cr\ \% - 29 \times (Ni\ \% + Cu\ \%) - 18.5 \times Mo\ \%$.

Most preferable, $MI \leqq -55$.

Steel with such a composition is known from EP953651 and used for cold heading, because of its high deformability, or for rubber reinforcement, because of the favorable combination of tensile strength and cost of manufacturing. According to the MI of the alloy, a maximum for the deformation $\epsilon$ may be used during diameter reduction of the composite wire.

The alloy of the stainless steel fibers as subject of the invention provide several advantages.

- The carbon content is lower than 0.05 wt %, because otherwise too much martensite makes the drawn material brittle. Typically, the carbon content is higher than 0.005 wt % because it is difficult to obtain a lower content during steel decarburisation.
- The manganese content is lower than 5 wt % to obtain deformable sulfide inclusions.
- The silicon content is lower than 2 wt % and attributes to cold work hardening.
- The nickel content is between 8 and 12 wt % to guarantee an austenitic crystal structure during wire rod rolling and after annealing treatments.
- The chromium content is between 15 wt % and 20 wt % to obtain a good corrosion resistance and to keep the efforts for pickling at an acceptable level.
- The molybdenum content is lower than 3 wt % and improves the corrosion resistance.
- The copper content is preferably limited to 4 wt % to avoid wire rod rolling difficulties.
- The content of nitrogen is limited to 0.05 wt % to avoid brittleness. Typically, the N content is higher tan 0.005 wt %.
- The sulfur content is limited to 0.03 wt % to avoid fractures.
- The content of phosphorus is limited to 0.05 wt % to avoid wire rod rolling defects.

Using an alloy as described above, and preferably but not necessarily satisfying above relationship, allows to obtain a deformation $\epsilon$ of the composite wire during drawing of the composite wire, which is higher than 4.5, for example higher than 4.8 or even 5.2 without necessitating an intermediate heat treatment.

Deformation $\epsilon$ is defined as the value of the logarithmic function of the ratio of the initial cross-section $S_1$ to the final cross-section $S_2$ of the composite wire.

$$\varepsilon = \ln\left(\frac{S_1}{S_2}\right)$$

With initial cross-section $S_1$ is meant the cross-section of the composite wire measured after a heat treatment and before the composite wire is further drawn. With final cross-section $S_2$ is meant the cross-section of the composite wire after deformation (drawing) without an intermediate heat treatment.

This deformation may comprise different drawing steps, one after another without intermediate heat treatment. $S_2$ is measured after the last drawing step and before the next heat treatment step if any.

According to a second aspect of the present invention a process for the manufacturing of stainless steel fibers by bundled drawing is provided.

The method according to the invention comprises the following steps:

a. providing stainless steel wires having a composition comprising iron and the following components expressed in percent of weight:
   $C \leqq 0.05\%$
   $Mn \leqq 5\%$
   $Si \leqq 2\%$
   $8 \leqq Ni \leqq 12\%$
   $15\% \leqq Cr \leqq 20\%$
   $Mo \leqq 3\%$
   $Cu \leqq 4\%$
   $N \leqq 0.05\%$
   $S \leqq 0.03\%$
   $P \leqq 0.05\%$
b. embedding the stainless steel wires in a matrix material;
c. enveloping the embedded stainless steel wires with enveloping material to form a composite wire;
d. alternatingly subjecting the composite wire to a diameter reduction, subjecting the reduced composite wire to a heat treatment and applying a final reduction; at least once a reduction with a deformation $\epsilon$ of at least 4.5, being used;
e. providing stainless steel fibers by removing the matrix material and enveloping material from the composite wire.

The final reduction provides a composite wire with a final diameter.

Preferably, the components of the alloy satisfy the following relationship:

$MI \leqq -40$, where $MI = 551 - 462 \times (C\ \% + N\ \%) - 9.2 \times Si\ \% - 20 \times Mn\ \% - 13.7 \times Cr\ \% - 29 \times (Ni\ \% + Cu\ \%) - 18.5 \times Mo\ \%$;

Most preferably, $MI \leqq -55$.

The stainless steel wires or wire rods provided in step a preferably have a diameter between 100 μm and 20 mm.

In a preferred method the stainless steel wires are embedded in the matrix material by applying a layer of a matrix material on each of the stainless steel wires in a first step.

The matrix material comprises for example copper, iron or a copper or iron alloy. The thickness of this layer is for example between 1 μm and 2 mm.

Possibly, the diameter of the coated wires is reduced by a drawing step.

After the application of a layer of a matrix material on the individual wires and possibly after the drawing of the coated wires, the wires may be brought together to form a bundle. Subsequently, an envelope material comprising for example copper or iron or a copper or iron alloy is applied around the bundle to form a composite wire.

Possibly, the method comprises a step of subjecting the composite wire to a heat treatment before reducing the diameter of the composite wire.

The reducing of the composite wire comprises the drawing of the wire by any technique known in the art. Alternatively, the reduction of the diameter may be obtained by a rolling operation.

Alternatingly, the composite wire is reduced in diameter and subjected to a heat treatment. The reductions may comprise several subsequent reduction passes, e.g. drawing operations on wire drawing machines.

According to the present invention, at least once a deformation $\epsilon$ of 4.5 or more is used to reduce the diameter of the composite wire. Preferably, such large reduction is used during the final reduction, providing a final diameter to the composite wire. Stainless steel fibers so obtained benefit most of the improvement of properties over its surface as subject of the invention.

Possibly, although not preferred, a heat treatment is applied after the final reduction.

Possibly, but not necessarily, a deformation $\epsilon$ of more than 4.5 is used for all drawing steps.

The removing of the matrix material comprises preferably the leaching of the composite wire using sulfuric or nitric acid.

For presently known stainless steel bundled drawn fibers, this deformation $\epsilon$ is kept less than 3, or even less than 2.5. To draw a composite wire from diameter immediately after the bundling step, to the final diameter of the composite wire, before removing the enveloping and matrix material, a lot of heat treatments are required when this $\epsilon$ is kept less than 3, especially because of the logarithmic nature of $\epsilon$. During each heat treatment, matrix material is diffused over a depth of the stainless steel wires, which depends largely on the temperature used during the heat treatment.

When a large diameter reduction may follow a heat treatment, as subject of the invention, the depth over which diffusion is observed after this diameter reduction with large $\epsilon$, is significantly smaller than if $\epsilon$ is to be kept smaller than 3, as was known in the art. The variation of this depth, caused by temperature variation during the heat treatment before the reduction with large $\epsilon$, becomes less in absolute value, as compared to presently known bundle drawing processes. Further, this variation is spread over a larger length of the stainless steel wires in the composite wire, since the composite wire elongates more due to this large $\epsilon$ as compared to presently known bundle drawing processes.

Stainless steel fibers according to the present invention can be used in many applications. They can for example be used in filter media, electrically conductive textiles, flocking on metal or polymer substrates, heat-resistant textiles, gas burner membranes or tubes, heating elements, conductive plastics or for EMI-shielding and ESD applications. "EMI-shielding" is to be understood as "electromagnetic interference shielding". "ESD" is to be understood as "electrostatic discharge".

At present, when stainless steel fibers are used in EMI shielding and ESD applications, there is a need for mechanically improved stainless steel fibers, having increased fracture strength, meanwhile having a better ductility.

It was found that fibers as subject of the invention may have improved fracture strength, being more than e.g. 2000 MPa, or even more than 2100 MPa. The ductility of the fiber, expressed as strain at fracture, may be more than 1% or even more than 1.1% such as more than 1.2%.

Most surprisingly it was found that even providing such improved mechanical properties, the standard deviation on these parameters of fracture strength and strain at fracture are significantly less, compared to the parameters of presently known stainless steel fibers. Standard deviations of less than 180 MPa, or even less than 140 MPa such as less than 130 MPa for the fracture strength may be obtained. Standard deviations of less than 0.15%, or even less than 0.12% or even less than 0. 1%, for the strain at fracture may be obtained.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Table I gives the composition of stainless steel fibers according to the present invention.

TABLE I

| | | Steel composition A | Steel composition B | Steel composition C |
|---|---|---|---|---|
| Content (in wt %) | C | 0.007 | 0.011 | 0.012 |
| | Mn | 1.28 | 1.75 | 0.88 |
| | Si | 0.74 | 0.36 | 0.68 |
| | Ni | 9.81 | 11.174 | 9.49 |
| | Cr | 18.19 | 18.76 | 17.5 |
| | Mo | 0.43 | 0.24 | 0.2 |
| | Cu | 0.35 | 0.26 | 3.15 |
| | N | 0.020 | 0.032 | 0.015 |
| | S | 0.001 | 0.009 | 0.001 |
| | P | 0.025 | 0.019 | 0.023 |
| MI | | −46 | −100 | −95 |

Figure 1:
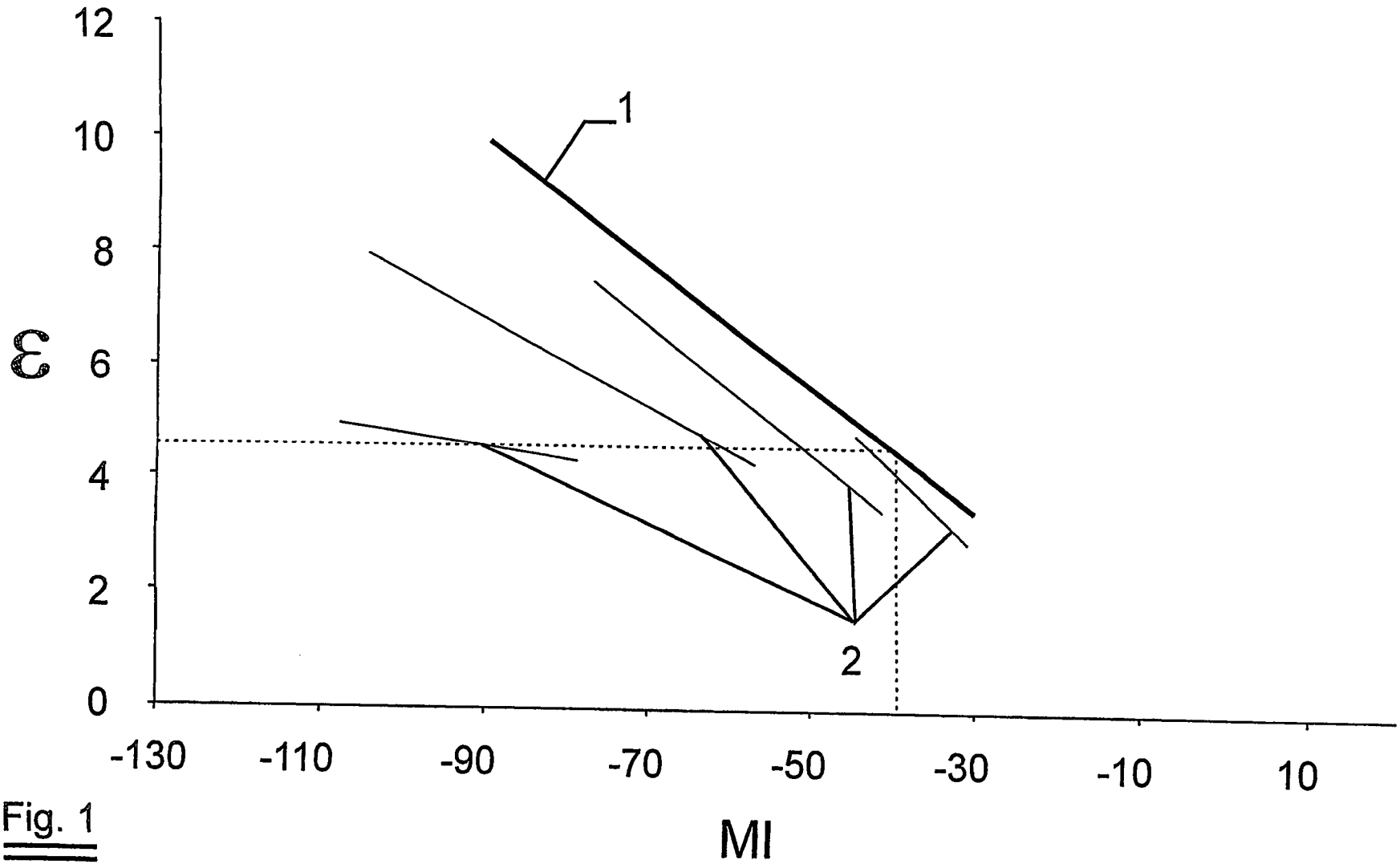
FIG. 1 shows the deformation $\epsilon$ that can be reached between two annealing steps as a function of the index MI.

FIG. 1 illustrates the deformation $\epsilon$ as function of the index MI defined by the composition of the alloy.

The bold line (1) represents the deformability limit, whereas the lines (2) represent lines of constant tensile strength. During reduction of the diameter of the composite wire, and thereby of the stainless steel wires in this composite wire, a deformation $\epsilon$ is to be chosen lower than the deformation limit (1), corresponding with the MI of the alloy chosen.

Figure 2:
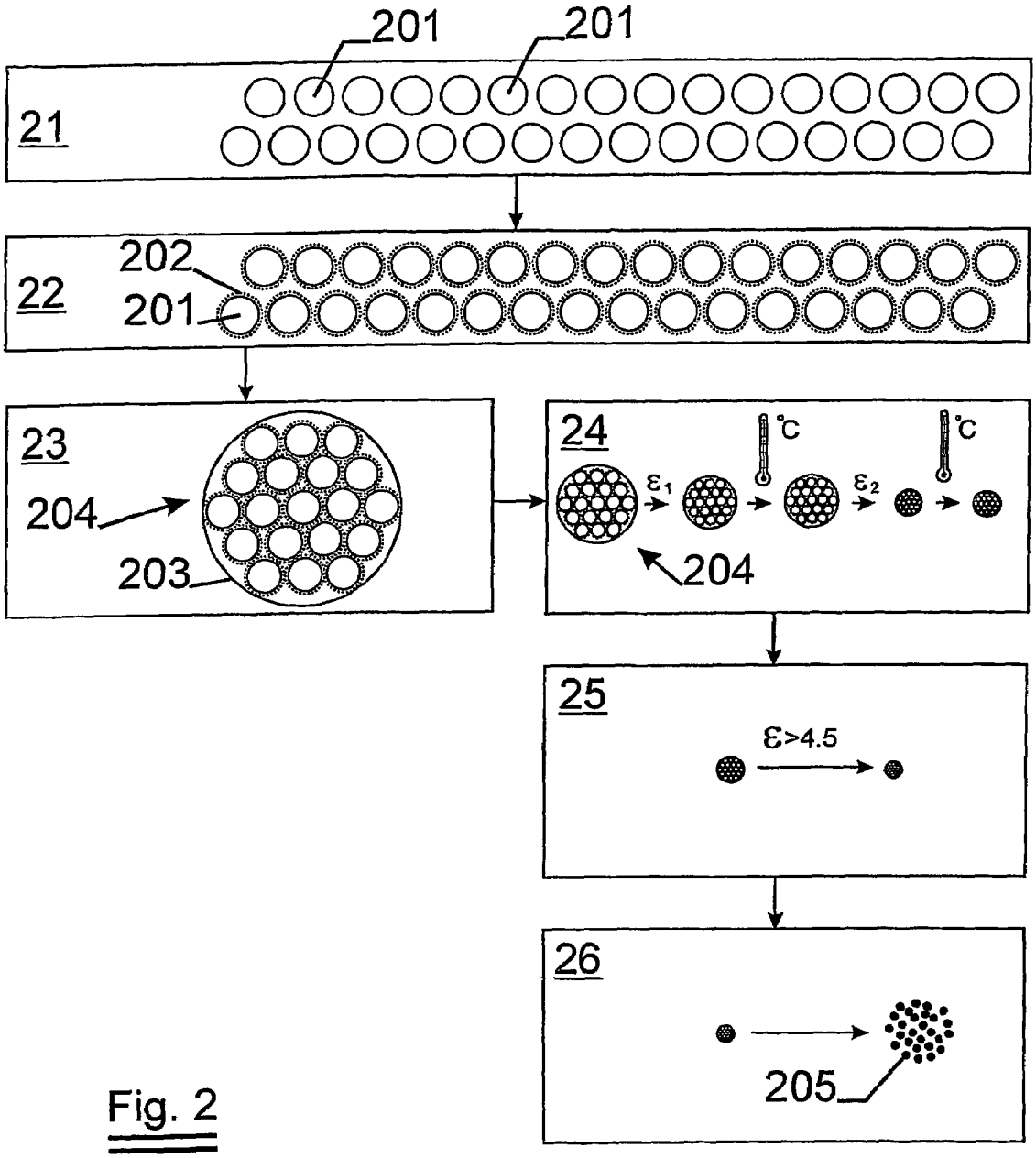
FIG. 2 shows schematically a preferred bundled drawing process as subject of the invention.

Stainless steel fibers as subject of the invention may be provided by using following preferred process, as schematically shown in FIG. 2. Stainless steel wires (201) of diameter between 0.5 and 1.5 mm, e.g. 1.4 mm and having a steel composition according to one of the examples above are provided in step 21. These stainless steel wires are coated by e.g. electrolytic coating with a layer of Cu (202) in step 22. Preferably, this layer ranges from 3 to 100 μm, e.g. 5 μm thickness. Possibly the coated stainless steel wires are reduced to a diameter ranging from 0.1 to 1 mm, e.g. 0.35 mm. Several coated wires, e.g. 1000, possibly reduced in diameter, are enveloped in an iron envelope (203), so providing a composite wire having a diameter in the range of 5 to 15 mm during step 23.

This composite wire (204) is alternatingly reduced with several $\epsilon$ (e.g. $\epsilon 1$, $\epsilon 2$) higher than 0.5, e.g. 1.5 and than annealed at a temperature in the range of 800 to 1100° C., E.g. 1030° C. This heat treatment takes 0.05 to 5 minutes, e.g. 2 minutes. These steps are represented as step 24. A final reduction 25 reduces the composite diameter with $\epsilon$ being higher than 4.5. This final reduction 25 provides the final diameter to the composite wire. Finally the matrix and enveloping material is removed (26) by pickling with an acid, e.g. nitric acid. Stainless steel fibers (205) with a diameter in the range of e.g. 6 to 15 μm are obtained, which have an Cu-diffusion of less than 1 at % over a depth of 100 nm over the whole surface of the fibers.

It is obvious for a person skilled in the art, that deformability and limited number of inclusions in the stainless steel wires may further positively influence the deformability of the composite wire.

The stainless steel fibers as subject of the invention have improved fracture strength and strain at fracture, as compared to similar presently known stainless steel fibers.

Figure 3:
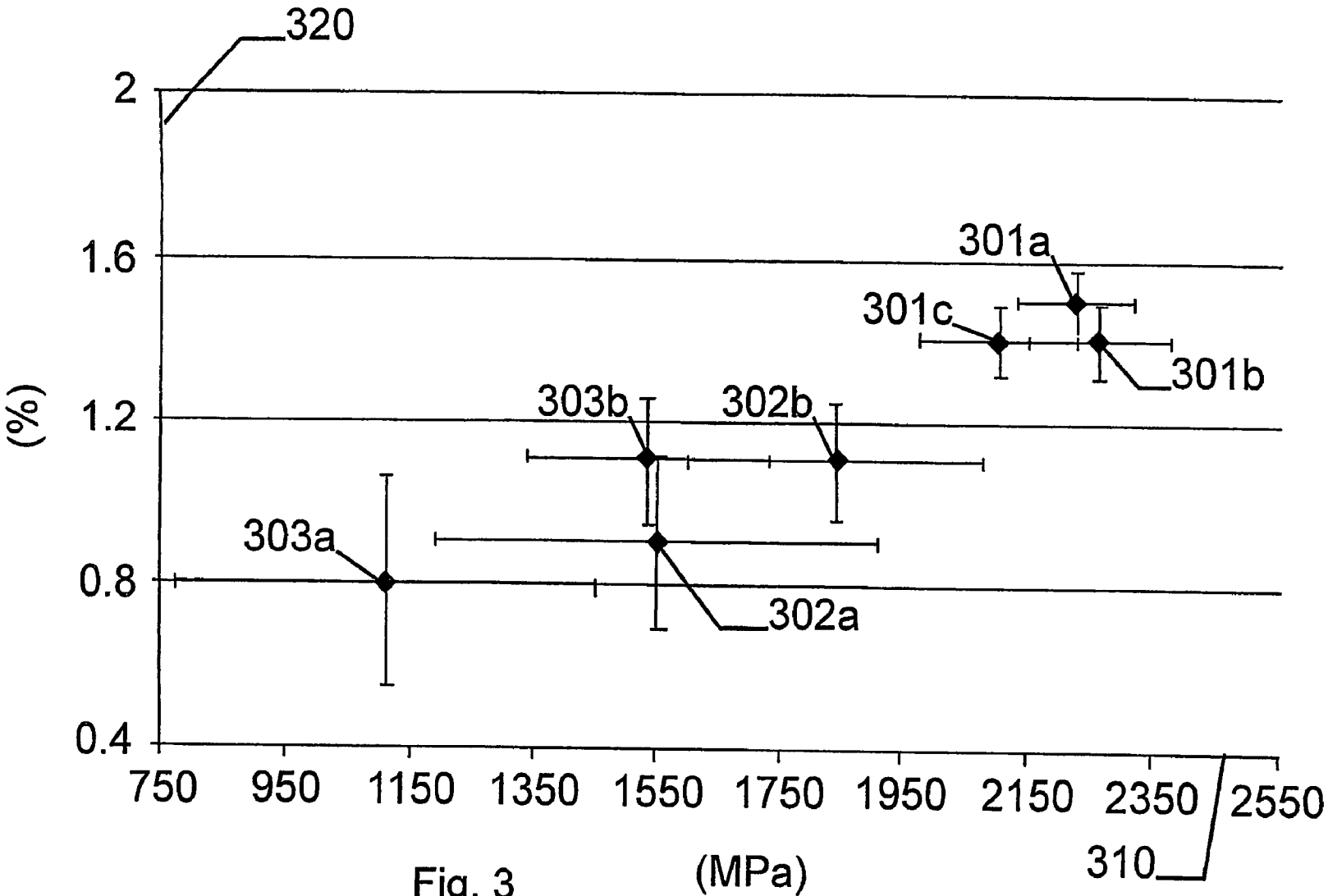
FIG. 3 shows fracture strength and strain at fracture of stainless steel fibers as subject of the invention, compared to presently known stainless steel fibers.

In Table II underneath, and in FIG. 3, examples of fracture strength, strain at fracture and the standard deviation on these properties, measured on stainless steel fibers as subject of the invention (sample 301*a*, 301*b* and 301*c*), and on presently known stainless steel fibers, out of AISI 302 alloy (sample 302*a* and 302*b*) or AISI 316L alloy (sample 303*a* and 303*b*) are provided.

TABLE II

| | | Fracture strength | | Strain at fracture | |
|---|---|---|---|---|---|
| sample | Fiber equiv. Diameter (μm) | Value (MPa) | Standard deviation (MPa) | Value (%) | Standard deviation (%) |
| 301a | 8 | 2229 | 94 | 1.5 | 0.08 |
| 301b | 8 | 2269 | 113 | 1.4 | 0.09 |
| 301c | 11 | 2106 | 126 | 1.4 | 0.09 |
| 302a | 8 | 1553 | 360 | 0.9 | 0.21 |
| 302b | 11 | 1842 | 238 | 1.1 | 0.15 |
| 303a | 8 | 1115 | 339 | 0.8 | 0.25 |
| 303b | 12 | 1539 | 195 | 1.1 | 0.16 |

The fracture strength (horizontal axis 310 in FIG. 3) of the stainless steel fibers as subject of the invention is more than 2000 MPa having a standard deviation of less than 180 MPa. The strain at fracture (in vertical axis 320 in FIG. 3) of the stainless steel fibers as subject of the invention is more than 1.1% meanwhile having a standard deviation of less than 0.15%.

It is clear that these values are significantly different from the values for fracture strength, strain at fracture and standard deviation on these parameters, as in presently known fibers 302*a*, 302*b*, 303*a* and 303*b*.

The invention claimed is:

1. A bundle drawn stainless steel fiber, comprising:

a bundle drawn stainless steel fiber, wherein said bundle drawn stainless steel fiber has an equivalent diameter being more than 0.5 μm, said equivalent diameter being less than 100 μm, said bundle drawn stainless steel fiber having a composition comprising iron and the following components expressed in percent by weight:

$C \leqq 0.05\%$,
$Mn \leqq 5\%$,
$Si \leqq 2\%$,
$8 \leqq Ni \leqq 12\%$,
$15\% \leqq Cr \leqq 20\%$,
$Mo \leqq 3\%$,
$Cu \leqq 4\%$,
$N \leqq 0.05\%$,
$S \leqq 0.03\%$,
$P \leqq 0.05\%$;

wherein said composition satisfies the following relationship:

$MI = 551 - 462 \times (C\% + N\%) - 9.2 \times Si\% - 20 \times Mn\% - 13.7 \times Cr\% - 29 \times (Ni\% + Cu\%) - 18.5 \times Mo\%$, said $MI \leqq -40$.

2. A bundle drawn stainless steel fiber according to claim 1, said MI being less than −55.

3. A bundle drawn stainless steel fiber according to claim 1, said bundle drawn stainless steel fiber having a fracture strength, said fracture strength having a standard deviation of less than 180 MPa.

4. A bundle drawn stainless steel fiber according to claim 3, said fracture strength being more than 2000 MPa.

5. A bundle drawn stainless steel fiber according to claim 1, said bundle drawn stainless steel fiber having a strain at fracture, said strain at fracture having a standard deviation of less than 0.15%.

6. A bundle drawn stainless steel fiber according to claim 5, said strain at fracture being more than 1%.

7. A bundle drawn stainless steel fiber according to claim 1, whereby diffusion of individual elements of a matrix material, used on said stainless steel wires during bundled drawing, is limited to less than 1 at % at a depth of 100 nm below the surface of said bundle drawn stainless steel fibers.

8. A bundle drawn stainless steel fiber according to claim 7, whereby said matrix material comprises a metal or a metal alloy.

9. A bundle drawn stainless steel fiber according to claim 8, whereby said metal or metal alloy comprises copper, iron or a copper or iron alloy.

10. A bundle drawn stainless steel fiber according to claim 1, said bundle drawn stainless steel fiber having a fracture strength, said fracture strength being more than 2000 MPa.

11. A bundle drawn stainless steel fiber according to claim 1, said bundle drawn stainless steel fiber having a strain at fracture, said strain at fracture being more than 1%.

12. A bundle drawn stainless steel fiber according to claim 1, wherein said bundle drawn stainless steel fiber has undergone a reduction with a deformation $\epsilon$ of at least 4.5.

13. A bundle drawn stainless steel fiber according to claim 12, wherein said bundle drawn stainless steel fiber has undergone a reduction with a deformation $\epsilon$ of at least 4.8.

14. A bundle drawn stainless steel fiber according to claim 12, wherein said bundle drawn stainless steel fiber has undergone a reduction with a deformation $\epsilon$ of at least 5.2.

15. A bundle drawn stainless steel fiber according to claim 1, said $MI \leqq -60$.

16. A bundle drawn stainless steel fiber according to claim 1, said $MI = -95$.

17. A bundle drawn stainless steel fiber according to claim 1, said $MI = -100$.

18. A bundle drawn stainless steel fiber according to claim 1, wherein the MI has a value that permits a reduction with a deformation of at least 4.5.

19. A filter media comprising a filter media with stainless steel fibers according to claim 1.

20. An electrically conductive textile comprising an electrically conductive textile with stainless steel fibers according to claim 1.

21. Flocking comprising flocking with stainless steel fibers according to claim 1.

22. A heat-resistant textile comprising a heat-resistant textile with stainless steel fibers according to claim 1.

23. A gas burner membrane comprising a gas burner membrane with stainless steel fibers according to claim 1.

24. A heating element comprising a heating element with stainless steel fibers according to claim 1.

25. A conductive plastic comprising a conductive plastic with stainless steel fibers according to claim 1.

26. EMI-shielding comprising EMI-shielding with stainless steel fibers according to claim 1.

27. An ESD device comprising an ESD device with stainless steel fibers according to claim 1.

28. A process for the manufacturing of bundle drawn stainless steel fibers by bundled drawing, said process comprising the steps of:

a. providing stainless steel wires having a composition comprising iron and the following components expressed in percent of weight:

$C \leqq 0.05\%$
$Mn \leqq 5\%$,
$Si \leqq 2\%$,
$8 \leqq Ni \leqq 12\%$,
$15\% \leqq Cr \leqq 20\%$,
$Mo \leqq 3\%$,
$Cu \leqq 4\%$,
$N \leqq 0.05\%$,
$S \leqq 0.03\%$,
$P \leqq 0.05\%$;

wherein said composition satisfies the following relationship:

$$MI = 551 - 462 \times (C\,\% + N\,\%) - 9.2 \times Si\,\% - 20 \times Mn\,\% - 13.7 \times Cr\,\% - 29 \times (Ni\,\% + Cu\,\%) - 18.5 \times Mo\,\%,$$

said $MI \leqq -40$.

b. embedding the stainless steel wires in a matrix material;

c. enveloping the embedded stainless steel wires with enveloping material to form a composite wire;

d. subjecting said composite wire to:

a diameter reduction, alternatingly subjecting said reduced composite wire to a heat treatment, and finally applying a final reduction; at least one of said diameter reduction or said final reduction including a reduction with deformation $\epsilon$ of at least 4.5;

e. providing stainless steel fibers by removing the matrix material and enveloping material from the composite wire.

29. A process according to claim 28, said MI being less than −55.

30. A process according to claim 28, for which said final reduction uses a deformation $\epsilon$ of at least 4.5.

31. A process according to claim 28, said process comprising a heat treatment after said final reduction.

32. A process according to claim 28, whereby said stainless steel wires have a diameter between 100 μm and 20 mm.

33. A process according to claim 28, said matrix material being copper or a copper alloy.

34. A process according to claim 28, said matrix material being iron or an iron alloy.

35. A process according to claim 28, whereby the removing of matrix material and enveloping material is done by sulfuric or nitric leaching.

36. A process according to claim 28, wherein at least one of said diameter reduction or said final reduction includes a reduction with deformation $\epsilon$ of at least 4.8.

37. A process according to claim 28, wherein at least one of said diameter reduction or said final reduction includes a reduction with deformation $\epsilon$ of at least 5.2.

38. A process according to claim 28, said $MI \leqq -60$.

39. A process according to claim 28, said $MI = -95$.

40. A process according to claim 28, said $MI = -100$.

41. A process according to claim 28, wherein the MI has a value that permits a reduction with a deformation of at least 4.5.

* * * * *